US006304665B1

(12) United States Patent
Cavallaro et al.

(10) Patent No.: US 6,304,665 B1
(45) Date of Patent: Oct. 16, 2001

(54) SYSTEM FOR DETERMINING THE END OF A PATH FOR A MOVING OBJECT

(75) Inventors: Richard H. Cavallaro, Mountain View; James R. Gloudemans, San Mateo; Stanley K. Honey, Palo Alto; Terence J. O'Brien, San Jose; Alan C. Phillips, Los Altos, all of CA (US); William F. Squadron, Scarsdale, NY (US); Marvin S. White, San Carlos, CA (US)

(73) Assignee: Sportvision, Inc., New York, NY (US)

( * ) Notice: Subject to any disclaimer, the term of this patent is extended or adjusted under 35 U.S.C. 154(b) by 0 days.

(21) Appl. No.: 09/283,729

(22) Filed: Apr. 1, 1999

Related U.S. Application Data

(60) Provisional application No. 60/080,612, filed on Apr. 3, 1998.

(51) Int. Cl.[7] ..... G06K 9/00

(52) U.S. Cl. ..... 382/106

(58) Field of Search ..... 382/100, 103, 382/106, 154, 181, 276, 285, 286, 291; 348/135, 139, 140, 142; 396/89, 94, 104, 121; 356/3, 4.01, 4.06, 919; 473/198, 199; 701/200, 201, 202, 204, 207, 211, 300

(56) References Cited

U.S. PATENT DOCUMENTS

| | | | | |
|---|---|---|---|---|
| 4,545,576 | | 10/1985 | Harris | 473/468 |
| 4,858,922 | | 8/1989 | Santavaci | 473/192 |
| 5,092,602 | | 3/1992 | Witler et al. | 473/199 |
| 5,138,322 | | 8/1992 | Nuttall | 342/126 |
| 5,363,297 | * | 11/1994 | Larson et al. | 700/91 |
| 5,401,026 | | 3/1995 | Eccher et al. | 473/199 |
| 5,413,345 | | 5/1995 | Nauck | 473/156 |
| 5,446,701 | * | 8/1995 | Utke et al. | 367/118 |
| 5,486,002 | * | 1/1996 | Witler et al. | 473/194 |
| 5,513,854 | * | 5/1996 | Daver | 700/91 |
| 5,605,326 | | 2/1997 | Spear, Jr. | 473/422 |
| 5,609,534 | | 3/1997 | Gebhardt et al. | 473/409 |
| 5,768,151 | * | 6/1998 | Lowy et al. | 463/2 |
| 5,868,578 | | 2/1999 | Baum | 434/247 |
| 5,912,700 | * | 6/1999 | Honey et al. | 348/157 |
| 5,926,780 | | 7/1999 | Fox et al. | 702/142 |
| 6,042,492 | | 3/2000 | Baum | 473/453 |
| 6,084,979 | * | 7/2000 | Kanade et al. | 382/154 |
| 6,093,923 | * | 7/2000 | Vock et al. | 250/206.1 |

OTHER PUBLICATIONS

Glen Dickson, "ESPN Checks Swings With Bat Track", magazine (Broadcasting & Cable) article, Jun. 22, 1998, pp. 46–47.

* cited by examiner

*Primary Examiner*—Andrew W. Johns
*Assistant Examiner*—Shervin Nakhjavan
(74) *Attorney, Agent, or Firm*—Vierra Magen Marcus Harmon & DeNiro LLP

(57) ABSTRACT

A system is disclosed that can determine the distance a baseball would have traveled after being hit if its path was not interrupted. Thus, when a player hits a home run and the ball collides with an obstruction such as the seating area of a stadium or a wall, the present invention can determine how far the ball would have traveled had the ball not hit the stadium or the wall. The present invention can also be used to determine information about the path of objects other than a baseball.

36 Claims, 6 Drawing Sheets

SYSTEM FOR DETERMINING THE END OF A PATH FOR A MOVING OBJECT

CROSS-REFERENCE TO RELATED APPLICATIONS

This application claims the benefit of U.S. Provisional Application No. 60/080,612, entitled, "System For Determining Information About Moving Objects," filed on Apr. 3, 1998, incorporated herein by reference.

BACKGROUND OF THE INVENTION

1. Field of the Invention

The present invention is directed to a system for determining information about the path of travel of a moving object.

2. Description of the Related Art

The remarkable, often astonishing, physical skills and feats of great athletes draw millions of people every day to follow sports that range from the power of football to the grace of figure skating, from the speed of ice hockey to the precision of golf. Sports fans are captivated by the abilities of a basketball players to soar to the rafters, of a baseball player to hit home runs, of a runner to explode down the track, etc. In televising these events, broadcasters have deployed a varied repertoire of technologies—ranging from slow-motion replay to lipstick-sized cameras mounted on helmets—to highlight for viewers these extraordinary talents. Fans are intrigued and excited by the efforts of athletes and the comparative abilities of athletes become topics of endless debate at water coolers, in sports bars, on the Internet, etc.

One piece of information that has never been available to fans of sports like baseball is the distance a baseball would have traveled when a home run is hit. In most cases a home run consists of a batter hitting the baseball over the home run fence. After the ball travels over the fence, it usually lands in the seating area. Because the ball's path of travel from the bat to a natural impact on the ground is interrupted by the ball hitting the stands, it is not known how far the ball would have traveled. Such information will not only create a statistic that reflects a critical athletic skill—batting power—but will also provide announcers with information that will enhance their analysis of the game. This information will be of tremendous interest to baseball fans, and to date there have been no successful attempts to reliably provide such information during the telecast of a game.

Therefore, a system is needed that can determine information about the path of a moving object, for example, the distance a baseball would travel if its path is not interrupted.

SUMMARY OF THE INVENTION

The present invention includes a system that can determine the distance a baseball will travel after being hit if its path is not interrupted. Thus, when a player hits a home run and the ball hits the stadium, the present invention can determine how far the ball would have traveled had the ball not collided with the stadium. The present invention can also be used to determine the path of a ball as well as the end of the path of the ball. In addition to baseball, the present invention can be used to determine similar information for moving objects at other events including sporting and non-sporting events.

In one embodiment of the present invention, the system determines one or more locations of the object or ball after the ball has been hit by a bat. The determined locations do not include the end of the ball's uninterrupted path, which is the location the ball would have landed if the ball's path was not interrupted (or obstructed) and the ball was allowed to land at the end of its natural path. After determining the one or more locations of the ball, the system uses the determined locations to determine the distance the ball would have traveled after being hit if the ball's path was not interrupted.

Another embodiment of the present invention includes capturing video images of an object and determining an end of a hypothetical uninterrupted path of the object based on the video images. The term uninterrupted path means the natural path an object would take without being obstructed (e.g. by a stadium or a pole). The term "hypothetical" is used to indicate that the ball did not or will not take the natural path; therefore, the path is not the actual path it is only a hypothetical path.

In another embodiment, the system initially determines a hypothetical uninterrupted path. The system subsequently determines a set of three dimensional locations of the object during its flight and updates the hypothetical uninterrupted path based on the set of three dimensional locations. Finally, the system determines the end of the hypothetical uninterrupted path. The determination of a path does not require that the coordinates of every point along the path be known. Rather, the determination of the path includes a determination of the mathematical relationship that can be used to find a point along the path. For example, knowing location and velocity data for a moving object, one or more equations can be created to describe the path of the moving object.

One implementation of the present invention includes a processor and a set of cameras in communication with the processor. The processor is also in communication with a storage element that stores program code for programming the processor to perform the methods disclosed herein.

These and other objects and advantages of the invention will appear more clearly from the following detailed description in which the preferred embodiment of the invention has been set forth in conjunction with the drawings.

DETAILED DESCRIPTION

The present invention can be used in conjunction with many different events and situations, including sporting events and events other than sporting events. For illustrative purposes, the embodiment described below is used in conjunction with the broadcast of a baseball game.

Figure 1:
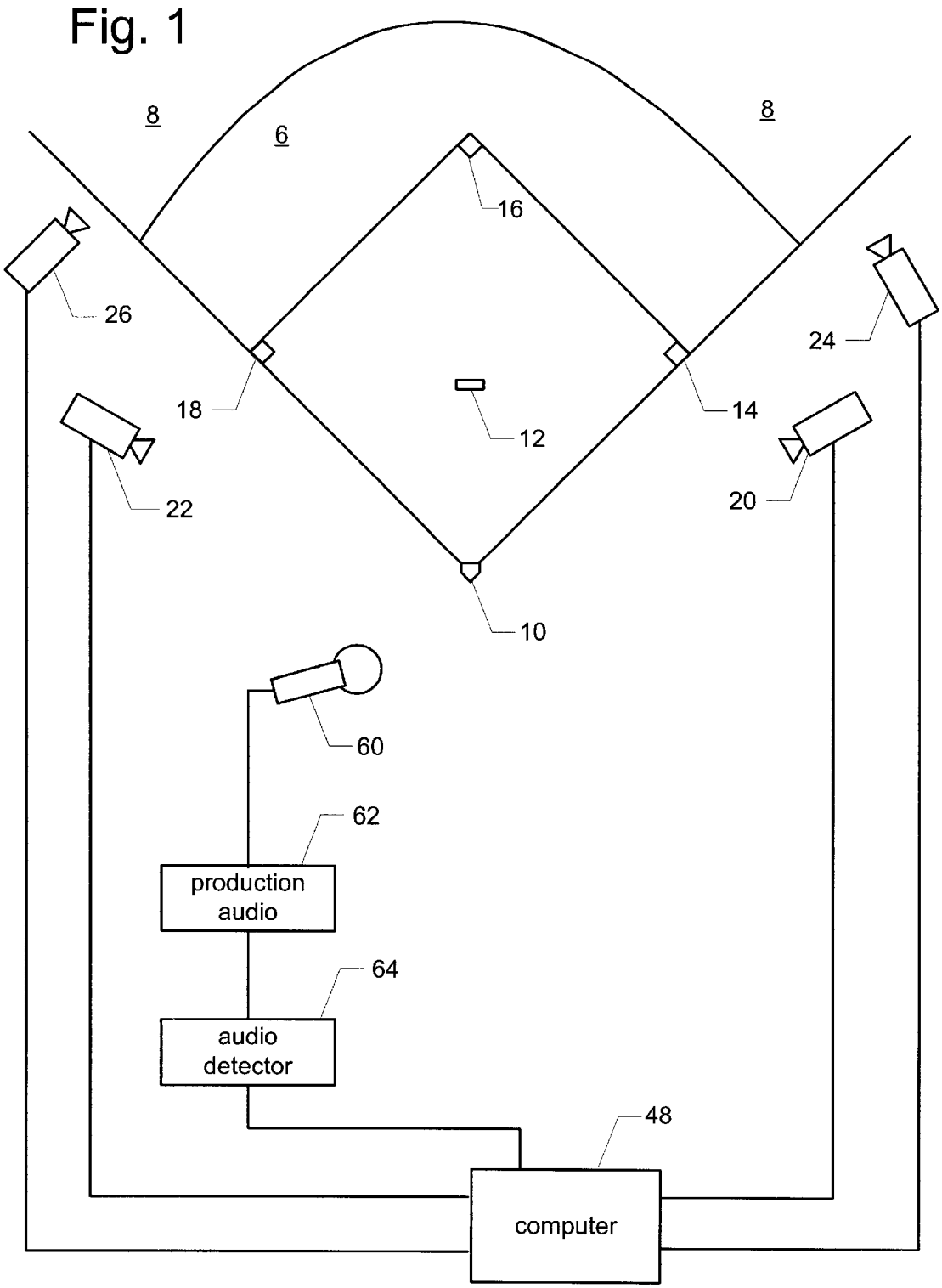
FIG. 1 is a drawing of a baseball field and the present invention.

FIG. 1 shows the hardware for one embodiment of the present invention in conjunction with a baseball field. Specifically, baseball field 6 is depicted having outfield 8, home plate 10, pitcher's mound 12, first base 14, second base 16 and third base 18. Typically, a pitcher would stand on pitcher's mound 12 and throw the ball to a catcher behind home plate 10. A batter would attempt to hit the ball while standing next to home plate 10. The far perimeter of outfield 8 is bordered by a home run fence (not shown). Typically, the baseball stadium includes seating for fans behind the home run fence.

FIG. 1 also shows four cameras 20, 22, 24 and 26. In one embodiment, cameras 20 and 22 are high quality instrumentation cameras that have a faster shutter speed and frame rate than a typical video camera. In another embodiment, cameras 20 and 22 will have a faster shutter speed, but the frame rate will be the normal NTSC 30 frames per second. Other cameras can also be used. Cameras 20 and 22 are located to the side of field 6, and are pointed at home plate 10 such that each camera has a field of view that includes home plate 10 and 20–30 feet in front of home plate 10. Cameras 20 and 22 are connected to computer 48. Cameras 20 and 22 are rigidly mounted with fixed pan, tilt, focus and zoom. In another embodiment, either camera 20 or 22 can be located behind or above home plate 10.

Cameras 24 and 26 are mounted on tripods (or other suitable fixtures) having servo motors that allow computer control of the pan and tilt of the two cameras. In one embodiment, the shutters of the cameras 24 and 26 are synchronized and the shutters of the cameras 20 and 22 are synchronized. Cameras 24 and 26 are connected to computer 48. Computer 48 can be an O2 workstation from Silicon Graphics. Other computers can also be used. Computer 48 includes a processor, memory, a hard disk, a floppy disk, a monitor, a printer, a keyboard, a pointing device, a CD-ROM drive, a modem and/or a network interface.

In one alternative, cameras 24 and 26 have a fixed zoom level. In another alternative, cameras 24 and 26 have servo motors to control the zoom of each camera. Cameras 24 and 26 can be standard interlaced video cameras. Computer 48 sends signals to the servo motors controlling the pan and tilt of cameras 24 and 26, thus, allowing cameras 24 and 26 to view the moving object. If cameras 24 and 26 had rapidly moving pan and tilt motors, fixed cameras 20 and 22 would not be necessary since cameras 24 and 26 could first be pointed at the batter and then rapidly be moved to point to outfield 8.

Located near home plate 10 is a microphone 60. In one alternative, instead of locating the microphone near home plate 10, microphone 60 can be designed to be located elsewhere but to pick up sounds from near home plate 10. Currently, most television broadcasters will bring many microphones to the game in order to pick up sounds from the playing field. It is customary for a broadcaster to locate one microphone near home plate 10. If the broadcaster is already locating a microphone near home plate 10, an additional microphone may not be necessary. That is, the system of the present invention can use a microphone already used by the broadcaster at the game. Even if a broadcaster has a microphone at the game, the system can still use a separate microphone. A broadcaster's microphone will typically be in communication with production audio 62. Production audio 62 is the production equipment used by the broadcaster at the game to produce the audio portion of the broadcast. The output of production audio 62, which is a signal received from microphone 60 with some modifications (e.g. amplification, filtering, etc.) is sent to audio detector 64. It is possible, in some embodiments, to bypass production audio 62. That is, microphone 60 can communicate directly to audio detector 64, which could include any necessary amplification and filtering circuits. Audio detector 64 is an electronic device that can detect one or more predetermined sounds. For example, in the system shown in FIG. 1 audio detector 64 can be designed to detect the sound of a bat hitting a baseball. Other sounds can also be detected. When audio detector 64 detects the sound of the bat hitting the ball, it will send a signal indicating that detection to computer 48. As will be described below, microphone 60 and the associated electronics are optional. That is, many embodiments of the present invention do not use any audio detection. For example, one embodiment relies on video and another embodiment uses radar technology.

Figure 2A:
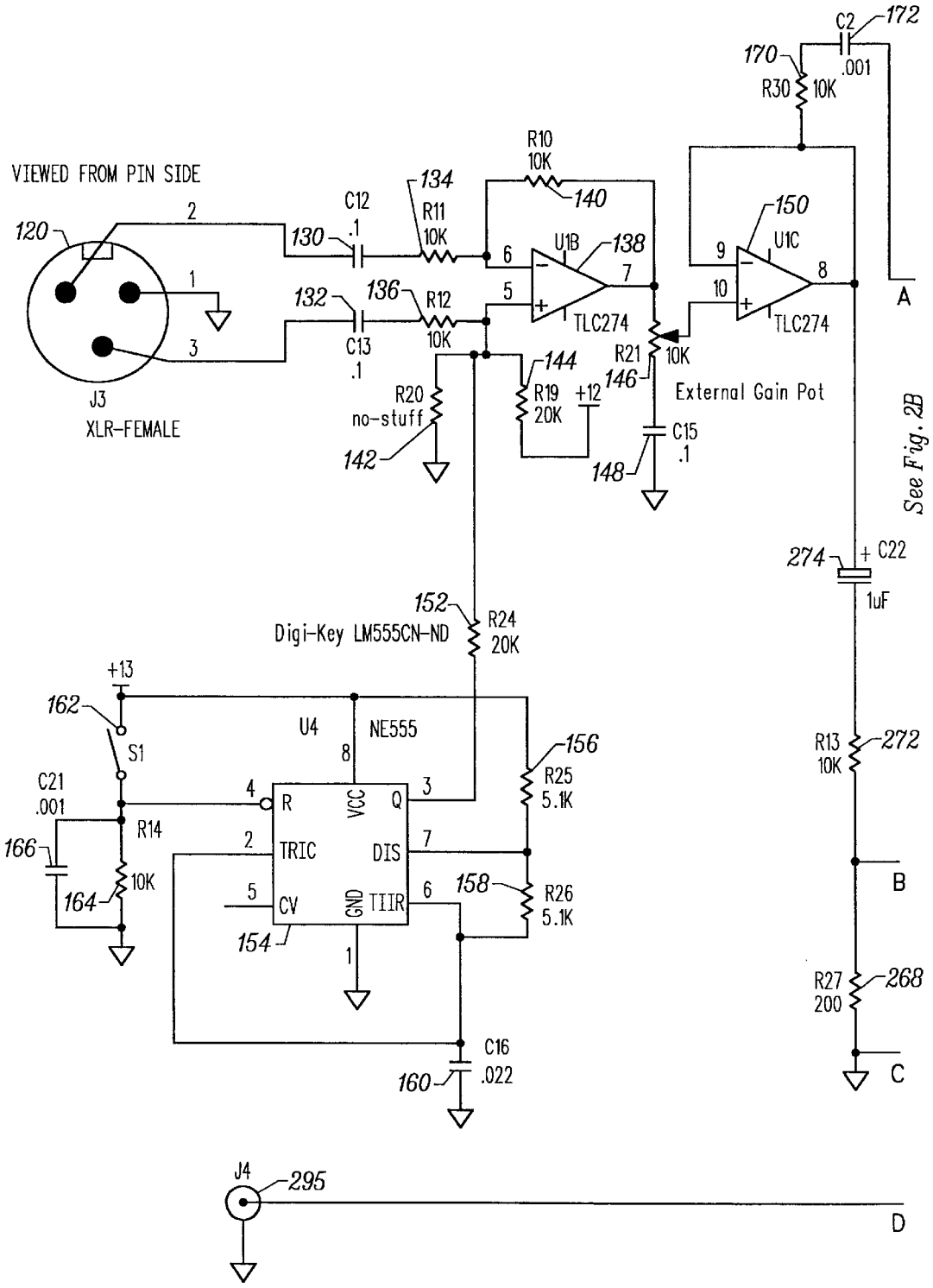
FIG. 2 is a schematic of a circuit used to detect the sound of a bat hitting a baseball.
Figure 2B:
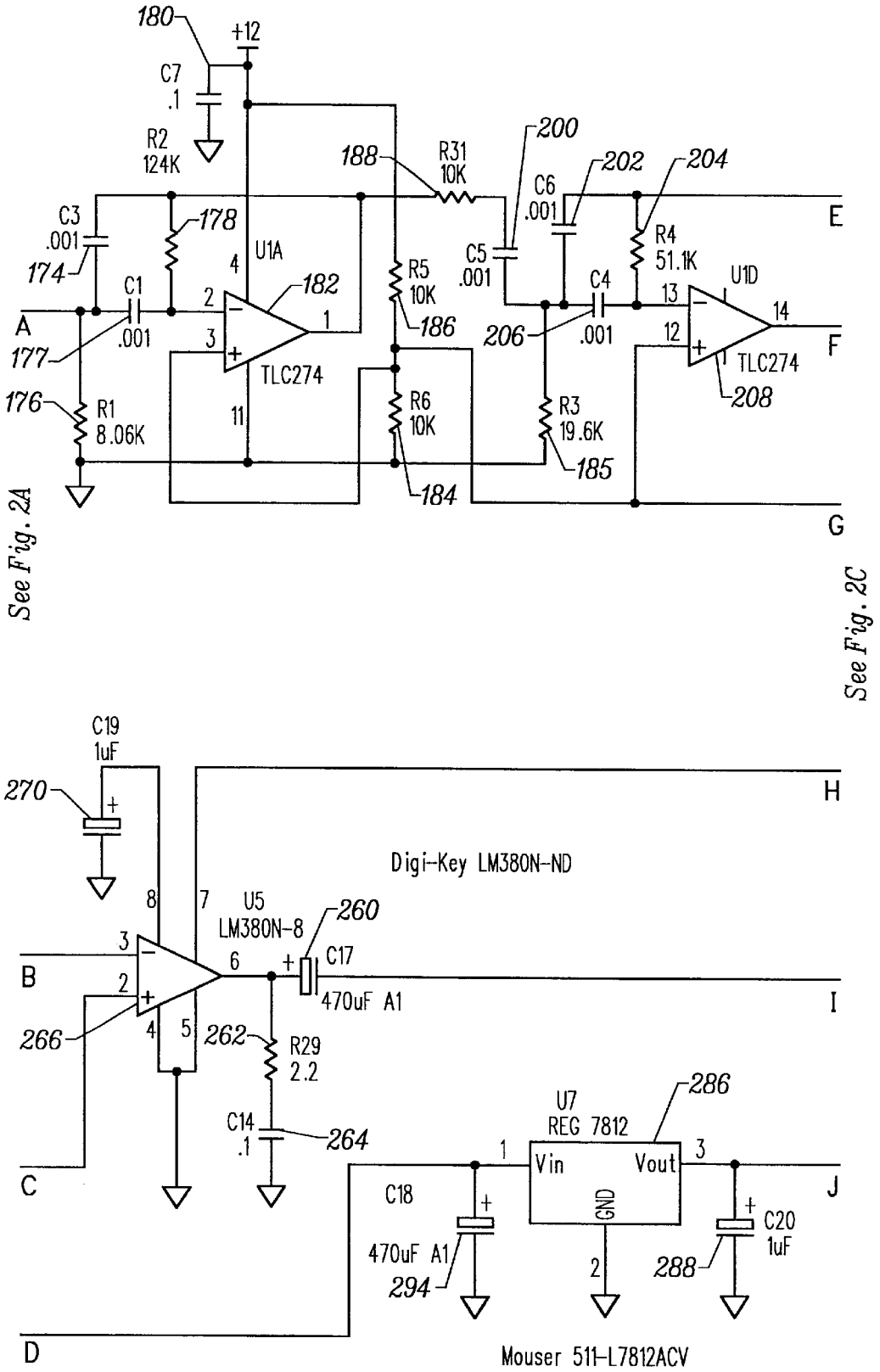
Figure 2C:
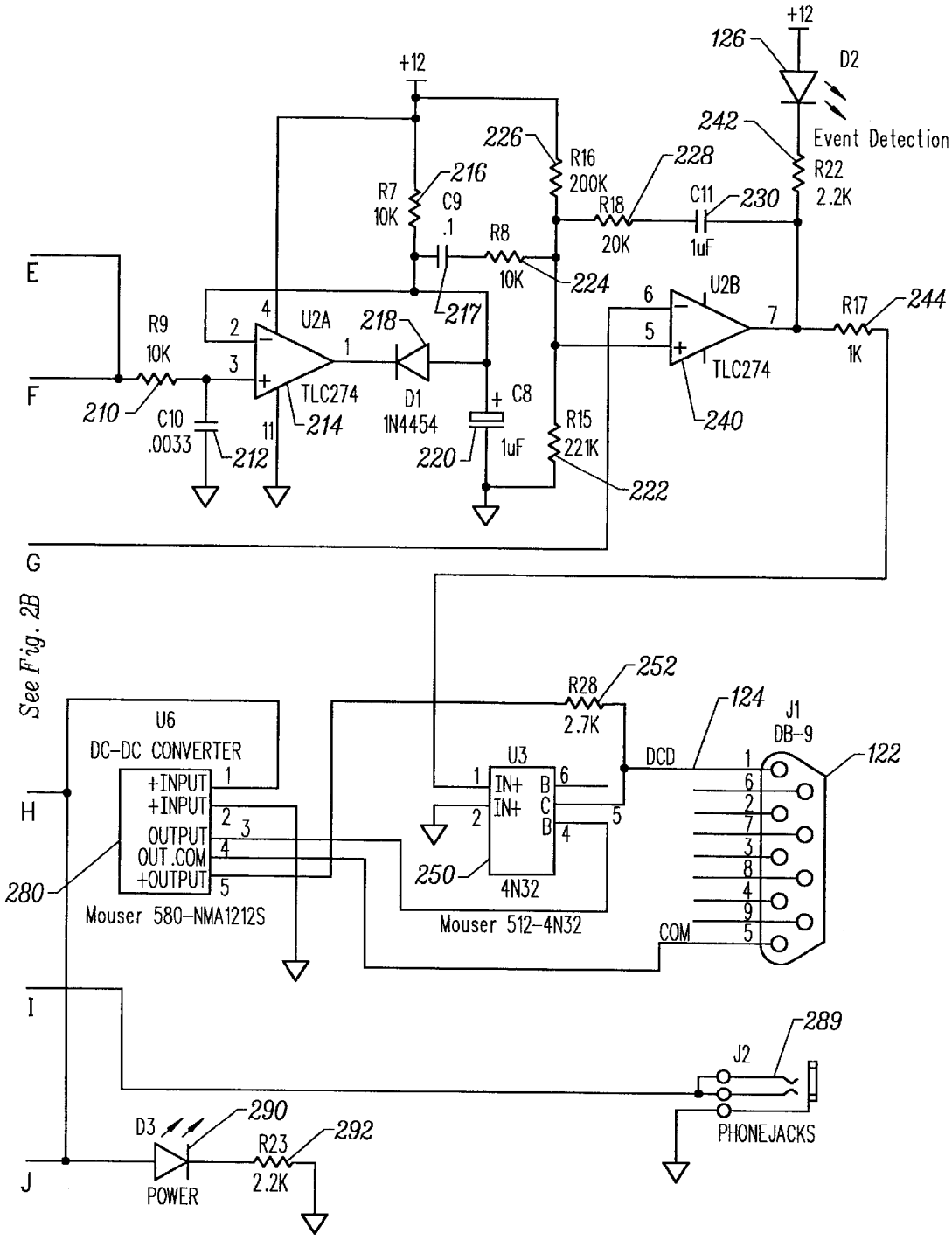

FIG. 2 is a schematic drawing of one embodiment of audio detector 64. The embodiment shown in FIG. 2 can detect the sound of a bat hitting a baseball. The input to the circuit of FIG. 2 is female connector 120, which would receive a signal from microphone 60. The output of the circuit of FIG. 2 is connector 122 which outputs a signal 124 (labeled as DCD) that indicates whether the circuit of FIG. 2 has detected the sound of a ball hitting a bat. The circuit of FIG. 2 also includes a light emitting diode (LED) 126 which also indicates whether the circuit of FIG. 2 detected the sound of the bat hitting the ball.

Connector 120 is connected to ground, capacitor 130 and capacitor 132. Capacitor 130 is also connected to resistor 134, and capacitor 132 is connected to resistor 136. Resistor 134 is connected to resistor 140 and an input of amplifier 138. Resistor 136 is connected to another input of amplifier 138, resistor 142 and resistor 144. Resistor 142 is also connected to ground, and resistor 144 is also connected to a 12 volt source. Resistor 140 is also connected to the output of amplifier 138 and potentiometer 146. Potentiometer 146 is connected to capacitor 148 and an input to amplifier 150.

Resistor 136 is also connected to the top of resistor 152. The other side of resistor 152 is connected to the Q output of pulse generator 154. The R input of pulse generator 154 is connected to switch 162, resistor 164 and capacitor 166. The other side of switch 162 is connected to the vcc input of pulse generator 154 and resistor 156. Switch 162 is used to test the circuit of FIG. 2 by generating a simulated bat crack sound signal. Resistor 164 and capacitor 166 are both connected to ground. The trigger input of pulse generator 154 is connected to capacitor 160 and resistor 158. Capacitor 160 is also connected to ground. Both resistors 156 and 158 are also connected to the DIS pin of pulse generator 154. The purpose of pulse generator 154 (and its accompanying components) is to create a signal representing the sound of a bat hitting the ball which can be used to test the circuit of FIG. 2 and the components of FIG. 1.

One of the inputs of amplifier 150 is connected to resistor 170 and capacitor 274. Resistor 170 is also connected to capacitor 172. Capacitor 172 is connected to capacitor 174, resistor 176 and capacitor 177. Capacitor 177 is connected to resistor 178 and one of the inputs of amplifier of 182. Resistor 178 is also connected to the output of amplifier 182 and resistor 188. Capacitor 180 is connected to ground, the vcc input of amplifier 182 and resistor 186. The other side of resistor 186 is connected to resistor 184, an input of amplifier 182, an input of amplifier 208 and an input of amplifier 240. Resistor 184 is also connected to ground, resistor 176, amplifier 182 and resistor 185. The other end of resistor 185 is connected to capacitor 200, capacitor 202 and capacitor 206. Capacitor 206 is also connected to resistor 204 and an input to amplifier 208. Resistor 204 is also connected to capacitor 202, the output of amplifier 208 and resistor 210. Resistor 210 is also connected to capacitor 212, which is connected to ground, and an input to amplifier 214. The other input of amplifier 214 is connected to diode 218, resistor 216, capacitor 217 and capacitor 220. The vcc input of amplifier 214 is connected to the top of resistor 216, resistor 226 and a 12 volt source. The other side of capacitor 217 is connected to resistor 224. Resistor 224 is also connected to resistor 222, resistor 228, resistor 226 and an input to amplifier 240. Resistor 222 is also connected to capacitor 220 and ground. Resistor 228 is connected to capacitor 230, which is connected to resistor 242, resistor 244 and the output of amplifier 240. The other side of resistor 242 is connected to LED 126, which is also connected to a 12 volt source.

Resistor 244 is connected to the output of amplifier 240 and the IN+input of opto-isolator 250. The IN−input of opto-isolator 250 is connected to ground. The B output of opto-isolator 250 is connected to resistor 252 and provides the DCD signal 124. The Eoutput of opto-isolator 250 is connected to the −OUTPUT of DC-DC converter 280. The OUTPUT common of DC-DC converter 280 is connected to the common pin of the output connector 122. The +OUTPUT from DC-DC converter 280 is connected to resistor 252. The −INPUT is connected to ground and the +INPUT of DC-DC converter 280 is connected to amplifier 266, LED 290 (indicates power is on), capacitor 288 and Vout regulator 286. LED 290 is also connected to resistor 292, which is also connected to ground. One example of a suitable opto-isolator device is a Mouser 512-4N32. A suitable DC-DC converter is the Mouser 580-NMA1212S. The ground pin for voltage regulator 286 is tied to ground. The Vin pin for voltage regulator 286 is connected to capacitor 294 (which is connected to ground) and to power supply input 295 (which connects to a DC power supply).

The output of amplifier 266 is connected to resistor 262 and capacitor 260. Resistor 262 is also connected to capacitor 264, which is connected to ground. Capacitor 260 is connected to phone jacks 289 which allows the operator to listen to the sound being processed by the circuit of FIG. 2. One terminal of capacitor 270 is connected to amplifier 266 and the other terminal is connected to ground. One end of resistor 268 is connected to an input of amplifier 266 and resistor 272. The other end of resistor 268 is connected to ground and to another input of amplifier 266. Resistor 272 is also connected to capacitor 274. Capacitor 274 is also connected to resistor 170, an input of amplifier 150 and an output of amplifier 150.

Figure 3:
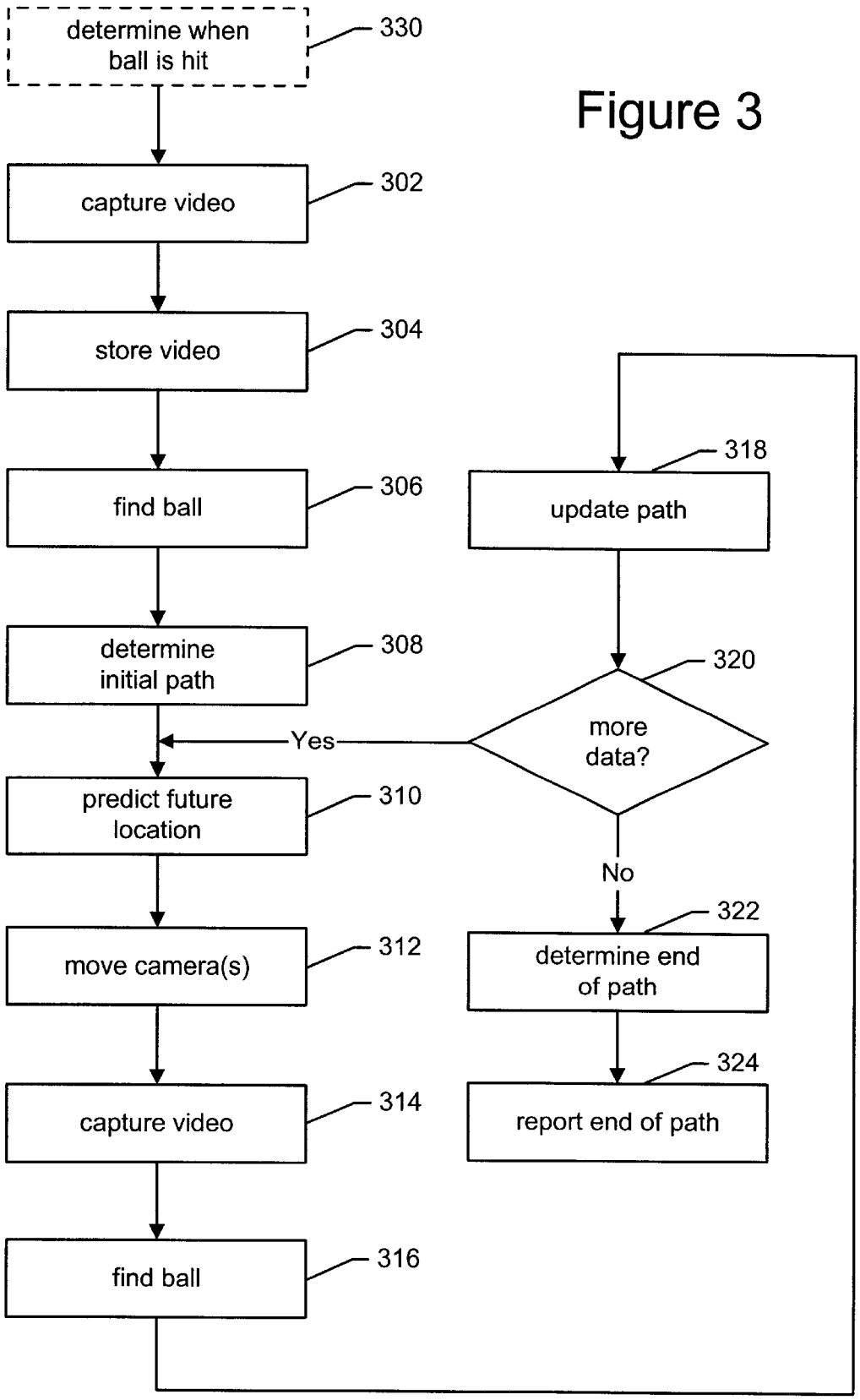
FIG. 3 is a flow chart describing the steps of a first embodiment of the present invention.

FIG. 3 shows the steps of a first embodiment for determining how far a ball will travel if its path is unimpeded. In step 302, cameras 20 and 22 capture video of the home plate area. Each of the frames of data captured by cameras 20 and 22 are sent to computer 48. In step 304, the captured video is stored in computer 48. In one embodiment, steps 302 and 304 are continuously performed throughout the event. In one alternative, step 304 stores the video in a circular buffer. In another embodiment, step 302 is performed continuously, but step 304 stops storing data within a small time (e.g. .5 seconds, 3 seconds, etc.) after it is determined that a bat hit a ball (optional step 322 discussed below).

In step 306, computer 48 finds the baseball inside the video frames received from cameras 20 and 22 and stored in step 304. Since the steps of FIG. 3 may have started before a bat hit a ball, step 306 may continue to search through the video as (or after) it is stored until it finds the ball traveling away from home plate 10. One embodiment of step 306 is accomplished using pattern recognition to find the ball in successive video frames moving in a direction away from home plate. In another embodiment, the pattern recognition is enhanced using subtraction techniques. In some cases, it may be possible to find the ball using subtraction without traditional pattern recognition techniques. One example of a suitable subtraction technique is to consider multiple video frames from one camera and subtract the data for successive video frames (or successive even and/or odd fields). The only objects that should be moving in the video are the player, the bat and the ball. Thus, only three groups of data will remain after subtracting two video frames. If subtraction is done from multiple sets of frames, the computer can identify one of the three groups of data that is moving away from the other two sets of data. That identified group of data is the baseball. The color, size and shape of the images can also be used as clues to identify the baseball. This process can be done for the video received from both cameras 20 and 22.

After computer 48 finds the ball in the videos, it determines the initial path of the ball in step 308. The initial path of the ball is the path the ball would take if there is no wind, spin or obstructions. By knowing the location, pan, tilt and zoom of cameras 20 and 22, the pixel positions of the ball in the video frames (from step 306) and timing of the video frames, computer 48 can determine the speed of the ball leaving the bat and a line of position for the ball in each frame. A line of position is a line (or vector) from the camera to the ball. The point of closest approach between a line of position for a video frame from camera 20 and a line of position for a corresponding in time video frame from camera 22 is the best estimate of the three dimensional location of the ball. Based on a set of three dimensional location values, computer 48 can determine an initial direction vector and a trajectory can be computed. The initial trajectory can be used to predict a path of the ball. More information about lines of position and determining three dimensional locations can be found in U.S. patent application Ser. No. 09/041,238, filed on Mar. 11, 1998, Cavallaro, et al., "System For Determining The Position Of An Object," and U.S. patent application Ser. No. 08/585,145, filed Jan. 10, 1996, Honey, et al., "System for Enhancing the Television Presentation of an Object at a Sporting Event," both applications are incorporated herein by reference.

The ball's path can change as it travels along the trajectory. Thus, cameras 24 and 26 are used to update the path as the ball travels. In one embodiment, cameras 24 and 26 are located on opposite sides of the field, approximately halfway between home plate and the home run fence. In step 310, computer 48 uses the previously determined trajectory to predict when the future path of the ball will be within the view of cameras 24 and 26. Computer 48 can predict a time and corresponding location along the ball's path and send signals to the servo motors for cameras 24 and 26 to point exactly at that predicted location at the appropriate time (step 312).

In one embodiment, cameras 24 and 26 would be manually panned and tilted (rather than using motors) to follow the ball or point to a future location of the ball. In this embodiment, cameras 24 and 26 would have pan and tilt sensors. Knowing the location of the cameras, the pan angle and the tilt angle, computer 48 can predict the time that the ball will be within the field of view of the camera and the pixel position. More information about pan and tilt sensors can be found in U.S. patent application Ser. No. 08/585,145, cited and incorporated above.

At the calculated time for the ball to be within the field of view of camera 24 and/or 26, computer 48 receives video images of the ball from cameras 24 and 26 in step 314. In step 316 computer 48 finds the ball in the video images received in step 314. In one embodiment computer 48 divides the images into successive pairs and subtracts the pairs of video images. Since cameras 24 and 26 were not moving when it captured the images in step 314, the video images should only differ by the position of the ball. Thus, subtracting two successive video images will remove the background data and leave two locations of the ball (or four in the case of interlaced images). Computer 48 determines lines of position, as discussed above, and the three dimensional location of the ball at multiple times. Computer 48 then determines whether the ball was where it was expected it to be. If so, the path is not updated. If the ball was not in the predicted location at the predicted time, the path is updated in step 318. In one alternative, step 316 also uses pattern recognition in conjunction with subtraction to find the ball. In another alternative, step 316 is performed using pattern recognition without subtraction. In one embodiment, an operator of the system would be able to choose whether to use the subtraction techniques.

In step 320, the system determines whether more data can be captured. That is, knowing the location of cameras 24 and 26, can the cameras be moved to view the ball at a future point in the ball's path. If so, the system loops back to step 310. If cameras 24 and 26 cannot be moved to view the ball, then computer 48 performs step 322 which includes determining the end of the ball's path.

In previous steps, computer 48 determined the ball's path. Step 322 includes determining the location at which the ball's path would intersect the ground (field level), assuming that the ball's path would not be interrupted by a fence, a person, a wall, stadium seating or any other obstruction. The location at which the ball's path would intersect the ground is compared to the location of home plate 10 to determine the distance that the ball would have traveled if the path was not interrupted. In step 324, the distance determined in step 322 is reported. The step of reporting includes displaying the information on a monitor, printing the information, using pre-stored audio files to report the information, passing the information to another function or process, transmitting the information to another computer or adding a graphic which indicates the determined distance (using a keyer) to a video of the baseball game. In a simple embodiment, reporting includes providing the information to a television announcer for the game.

In one embodiment, the steps of FIG. 3 are performed in real time. In another embodiment, steps 316, 318, 322 and 324 are performed slower than in real time but quick enough to report results within 30 seconds of the ball's path being terminated. To be most useful, the system should provide results before the next pitch. In some cases, results before the next batter is sufficient.

In one embodiment, step 320 can be eliminated and steps 310–318 are only performed once. In another embodiment, the system includes additional cameras and steps 310–318 are performed for the additional cameras. In one embodiment, the steps can also be performed using a manual digitizing technique.

In an alternative embodiment, cameras 24 and 26 (and/or their servo motors) are directly connected to a local computer, for example, a PC using an Intel Pentium processor. Each of the local computers are connected to computer 48. In another embodiment, computer 48 can include multiple processors or multiple computers.

In another alternative embodiment, cameras 24 and 26 are replaced with a set of cameras having fixed pan, tilt and zoom. The set of cameras includes enough cameras to have sufficient coverage of the outfield such that each part of the outfield is within the field of view of at least two separately located cameras. Rather than move servos motors to point cameras at the predicted location of the ball, the system would use the predicted location of the ball to select the appropriate subset of cameras. Alternatively, many cameras can be simultaneously selected if there is sufficient bandwidth and computing power. In another alternative, steps 310, 314, 316 and 318 can be performed for multiple subsets of cameras.

FIG. 3 shows step 330 in dotted lines because this step is optional. Step 330 is used to conserve resources on computer 48. In step 330, the system determines the moment when the ball is hit by the bat. In the embodiment of FIG. 1, the sound of the bat hitting the ball is detected by audio detection circuit 64. Audio detection circuit 64 sends a signal to computer 48 that the ball has been hit. By knowing the moment that the bat hit the ball, the process of finding the ball (step 306) can be restricted to frames of video within a time window of the bat hitting the ball. This free up processor resources on computer 48.

Figure 4:
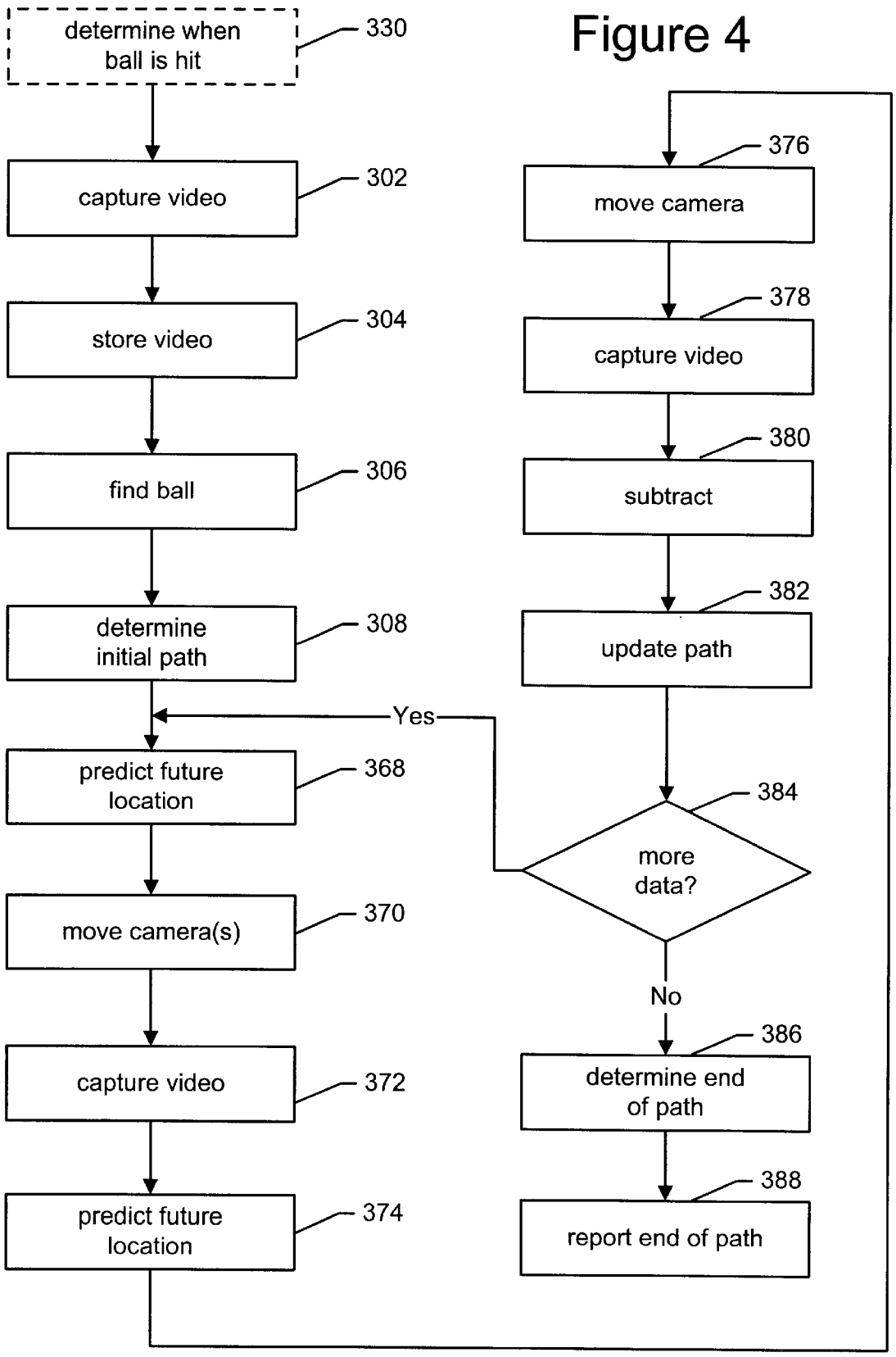
FIG. 4 is a flow chart describing the steps of a second embodiment of the present invention.

FIG. 4 is a flow chart describing the steps of a second embodiment for determining the distance a ball will travel. The first four steps of FIG. 4 are the same as the first four steps in FIG. 3. In step 368, the system predicts the future location of the ball, similar to step 310 of FIG. 3. In step 370, cameras 24 and 26 are moved so that the ball will soon appear in the center of each of the camera's field of view. In step 372, the cameras capture a first set of video frames. In step 374, the computer 48 determines a future location of the ball and moves (step 376) the cameras so that the ball will be in the center of the cameras' field of view. In one embodiment, step 374 includes finding the ball in the video captured in step 372 and using that pixel location to predict the future location. In another embodiment, the future location is determined using the data from steps 306 and 308. In step 378, the cameras capture a second set of video frames. In step 380, the frames of video for each camera captured in step 372 are subtracted from the frames of video captured by the same camera in step 378. Step 380 includes shifting the pixels of the video frames prior to subtraction. That is, computer 48 knows how cameras 24 and 26 were moved between video frames. Thus, computer 48 can calculate an offset and shift, rotate or scale the pixels of the video frames captured in step 378 so that the background of the two video frames align with minimal error. When subtracting two frames, the background should subtract out and only the locations of the ball will remain. Based on the pixel locations of the ball and the time the video frames were captured, computer 48 determines the three dimensional location of the ball at multiple times and updates the path of the ball in step 382. Step 384 is similar to step 320 of FIG. 3. If more data can be captured using any of the cameras, the system loops back to step 368. Otherwise, the system predicts the end of the ball's path in step 386 and reports that information in step 388. Note that in the steps of FIG. 4, the zoom setting of each camera is constant. While it is possible to operate the system if the zoom settings for each camera is not constant, the task would be significantly more difficult. If the steps of subtraction create too large of an error due to camera jiggle or other external factors, computer 48 can offset one of the video frames to compensate accordingly.

In one alternative embodiment, a Doppler radar system can be used to determine the moment a ball hit a bat. In that embodiment three or more radar units can be placed behind home plate, pointing at home plate. For example, five radar units can be placed behind home plate with a first radar unit directly behind home plate, two radar units separated from the first radar unit by twelve degrees and two more radar units separated from the first radar unit by twenty two degrees. A computer performs a Fourier Transform or Fast Fourier Transform on the data from the radar units. The transformed data indicates velocity information, which includes data about speed and direction. The computer can be programmed to find the data representing the ball and to identify when the direction of the ball changes. The point when the direction of the ball changes is the moment that the bat hit the ball. In some instances, the data representing the ball may have a gap at the point the direction of the ball changes. To compensate, the system can interpolate or use other known mathematics (e.g. Rate×Time=Distance) to calculate the time the bat hit the ball. The computer can also be programmed to identify the time the bat hit the ball by looking for velocity information about the bat in order to identify when the bat speed abruptly changes due to contact with a ball.

In one embodiment of the radar system, the radar units can be used to determine a set of three dimensional velocity vectors representing the velocity of the ball. A set of velocity vectors can be used to determine the path of the ball. In such an embodiment, an "out of plane" radar could be used that looks downward toward home plate 10 to capture the vertical velocity component of the ball.

Various radar units can be used with the present invention. One example of a suitable radar unit is sold as part of the Stalker Dual DSR Moving Radar from Applied Concepts, Inc., 730 F Avenue, Suite 200, Plano, Tex. 75074. The Stalker radar system is typically sold as a complete radar system for measuring the speed of objects. The present invention will only utilize what is called the antenna unit portion of the Stalker radar system. The antenna unit is basically a radar transmitter/receiver. Other Doppler radar units can also be used.

Another use of the present invention is to predict and display the path of a moving object. For example, after the present invention determines the initial path of a baseball, the path can be displayed. In one alternative, the system can add a target graphic to the video image of a baseball field to show the location where the ball will land (e.g. the end of the path). As the system updates the path of the ball, the displayed path and the displayed graphic at the end of the path can also be updated. For example, if a batter hits a fly ball to the outfield, while the outfielder is attempting to catch the ball the television display can show the path of the ball and the location in the outfield where the ball will land. That way, the viewer of the game on television will see if the outfielder is in the correct position. The graphic and the path can be created by a computer and added to the video of the baseball game using a keyer. More information about adding images to a video can be found in U.S. patent application Ser. No. 08/585,145, filed Jan. 10, 1996, Honey, et al., "System for Enhancing the Television Presentation of an Object at a Sporting Event," incorporated herein by reference.

The present invention has been described in relation to determining how far a baseball would have traveled. However, the present invention can be used to determine the distance or path of travel (or predicted travel) of other moving objects. For example, the system can be used to measure the distance of travel for a golf ball, football, soccer ball, javelin, shot put, frisbee, or other moving object (including objects not related to sporting events).

The above description discusses the use of video frames and assumes an NTSC video format. However, the present invention will work with other video formats (e.g. PAL, SECAM, HDTV, etc.). Although the above discussion specifically mentions frames of video, it is known that NTSC frames include odd and even fields. One skilled in the art will understand that the methods disclosed herein can be discussed or practiced in regard to fields or frames.

The foregoing detailed description of the invention has been presented for purposes of illustration and description. It is not intended to be exhaustive or to limit the invention to the precise form disclosed, and obviously many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A method for determining information about a hypothetical uninterrupted path of a ball after said ball is hit by a bat, comprising the steps of:

sensing camera orientation data for a set of one or more cameras pointing at said ball while said ball is traveling along said hypothetical uninterrupted path, said step of sensing uses one or more camera orientation sensors;

capturing video images of said ball while said ball is traveling along said hypothetical uninterrupted path, said video images are captured using said set of one or more cameras; and determining an end of said hypothetical uninterrupted path based on said captured video images and said camera orientation data.

2. A method according to claim 1, wherein:

said one or more camera orientation sensors includes a pan sensor.

3. A method according to claim 1, further including the step of:

determining a distance from a beginning of said hypothetical uninterrupted path to said end of said hypothetical uninterrupted path.

4. A method according to claim 3, further including the step of:

reporting said distance.

5. A method according to claim 1, further including the step of:

displaying said end of said hypothetical uninterrupted path.

6. A method according to claim 1 ,wherein said step of determining said end of said hypothetical uninterrupted path includes the steps of:

finding said ball in said video images;

initially determining said hypothetical uninterrupted path; and updating said hypothetical uninterrupted path.

7. A method according to claim 6, wherein said step of initially determining said hypothetical uninterrupted path includes the steps of:

determining a set of three dimensional locations of said ball; and using said three dimensional locations to determine an initial trajectory.

8. A method according to claim 6, wherein said step of updating said hypothetical uninterrupted path includes the steps of:

predicting a future location of said ball;

moving two cameras to point at said predicted future location after said step of predicting and prior to said ball reaching said future location;

finding said ball in video images from said two cameras pointed at said predicted future location; and updating said hypothetical uninterrupted path based on said step of finding said ball in video images from said two cameras.

9. A method according to claim 6, wherein said step of updating said hypothetical uninterrupted path includes the steps of:

predicting a future location of said ball;

selecting two cameras that are pointing at said future location;

finding said ball in video images from said two cameras; and updating said hypothetical uninterrupted path based on said step of finding said ball in video images from said two cameras.

10. A method according to claim 6, wherein said step of updating said hypothetical uninterrupted path includes the steps of:

predicting a first future location of said ball;

moving a camera to point at said first future location;

capturing a first set of one or more video images from said camera pointed at said first future location;

predicting a second future location of said ball;

moving said camera to point at said second future location;

capturing a second set of one or more video images from said camera pointed at said second future location;

subtracting one or more video images of said first set of video images from one or more video images of said second set of video images in order to find said ball; and updating said hypothetical uninterrupted path based on said step of subtracting.

11. A method according to claim 6, wherein:

said step of finding said ball in said video images includes performing pattern recognition.

12. A method according to claim 6, wherein:

said step of finding said ball in said video images includes subtracting video images.

13. A method according to claim 1, further including the step of:

reporting information based on said step of determining an end of said hypothetical uninterrupted path.

14. A method according to claim 1, wherein said step of determining an end of said hypothetical uninterrupted path comprises the steps of:

determining positions of said ball in said captured video images;

using said positions of said ball in said captured video images and said camera orientation data to determine two or more three dimensional locations of said ball; and using said more three dimensional locations of said ball to determine said end of said hypothetical uninterrupted path.

15. A method for determining a distance a ball would have traveled after being hit by a bat, comprising the steps of:

determining one or more locations of said ball after said ball has been hit by said bat, said step of determining is performed during a game, said determined locations do not include an end of said ball's uninterrupted path; and using said determined locations to determine said distance said ball would have traveled after being hit if said ball's path was not interrupted, said step of using said determined locations comprises the steps of:

determining path information using a first set of location data, using said path information to predict a future location, capturing video from a set of cameras looking at said future location, and using said captured video to determine said distance.

16. A method according to claim 15, wherein:

said step of using said determined locations is performed in real time.

17. A method according to claim 15, wherein:

said step of using said determined locations is performed within thirty seconds of said bat hitting said ball.

18. A method according to claim 15, wherein:

said step of using said determined locations is commenced while said ball is airborne.

19. A method according to claim 15, wherein:

said step of determining one or more locations is performed using pattern recognition on a set of video images.

20. A method according to claim 15, further including the step of:

identifying a sound of said bat hitting said ball, said step of determining one or more locations is triggered by said said step of identifying.

21. A method according to claim 15, wherein:

said step of determining one or more locations is performed using subtraction and pattern recognition on a set of video images.

22. A method according to claim 15, wherein said step of using said determined locations further includes the step of:

pointing said set of cameras toward said future location in response to said step of using said path information to predict said future location.

23. A method according to claim 15, wherein said step of using said determined locations further includes the step of:

selecting said set of cameras from a group of cameras because said set of cameras are pointing toward said future location, said step of selecting is performed in response to said step of using said path information to predict said future location.

24. An apparatus for determining information about a ball's travel along a hypothetical uninterrupted path, comprising:

a first video camera capable of being oriented;

a first set of one or more camera orientation sensors, said first set of camera orientation sensors sense camera orientation data for said first camera;

a second video camera capable of being oriented;

a second set of one or more camera orientation sensors, said second set of camera orientation sensors sense camera orientation data for said second camera;

a storage element capable of storing program code; and a processor in communication with said first video camera and said second video camera and said storage element, said processor programmed by said program code to perform a method comprising the steps of:

receiving video images from said first and second video cameras captured while said first and second cameras are pointed at said ball traveling on said uninterrupted path;

receiving a first set of camera orientation data from said first set of camera orientation sensors, said first set of camera orientation data pertains to an orientation of said first camera while said first camera is pointed at said ball traveling on said uninterrupted path;

receiving a second set of camera orientation data from said second set of camera orientation sensors, said second set of camera orientation data pertains to an orientation of said second camera while said second camera is pointed at said ball traveling on said uninterrupted path; and determining an end of said hypothetical uninterrupted path of said object based on said video images received from said first and second video cameras, said first set of camera orientation data and said second set of camera orientation data.

25. An apparatus according to claim 24, further including:

an output device for reporting information about said end of said uninterrupted path of said ball.

26. An apparatus according to clam 25, wherein:

said information includes a distance said ball would have traveled, but did not travel, had the ball's path not been interrupted.

27. An apparatus according to claim 24, further including:

a third camera in communication with said processor, said third camera is rigidly mounted to point toward a location where said ball is likely to be hit by a bat; and a fourth camera in communication with said processor, said fourth camera is rigidly mounted to point toward said location where said ball is likely to be hit by said bat, said processor uses video from said third camera and said fourth camera to perform said step of determining an end of said hypothetical uninterrupted path.

28. An apparatus according to claim 27, further including:

a first set of one or more motors in communication with said processor, said first set of one or more motors capable of changing an orientation of said first camera based on instructions from said processor; and a second set of one or more motors in communication with said processor, said second set of one or more motors capable of changing an orientation of said second camera based on instructions from said processor, said processor predicts a future location of said ball and instructs a changing of orientation of said first camera and said second camera so that said first camera and said second camera point toward said predicted future location prior to said ball reaching said predicted future location.

29. An apparatus according to claim 24, further including:

a microphone; and audio detection electronics in communication with said microphone and said processor, said audio detection electronics sends a signal to said processor when a sound of a bat hitting said ball is detected, said processor uses said signal to start said step of finding said ball in said video images.

30. An apparatus according to claim 24, wherein said step of determining an end of said hypothetical uninterrupted path comprises the steps of:

storing positions of said ball in said video images received from said first and second video cameras;

using said positions of said ball in said video images and said camera orientation data to determine two or more three dimensional locations of said ball; and using said more three dimensional locations of said ball to determine said end of said hypothetical uninterrupted path.

31. A method for determining information about a hypothetical uninterrupted path of a ball after being hit by a bat, comprising the steps of:

detecting a sound of said bat hitting said ball;

capturing video images of said ball; and determining an end of said hypothetical uninterrupted path of said ball based on said captured video images, said step of determining is performed in response to said step of detecting.

32. A method according to claim 31, further comprising the steps of:

determining a distance from a beginning of said hypothetical uninterrupted path to said end of said hypothetical uninterrupted path; and reporting said distance.

33. A method according to claim 32, wherein said step of determining an end includes the step of:

determining path information for said ball;

using said path information to predict a future location of said ball;

pointing a set of cameras toward said future location in response to said step of using said path information to predict said future location;

capturing first video from said set of cameras looking at said future location; and using said captured first video to determine said end of said hypothetical path.

34. A method according to claim 32, further comprising the step of:

displaying, in a video of a baseball game, said hypothetical uninterrupted path and said end of said hypothetical uninterrupted path while said ball is traveling along said hypothetical uninterrupted path.

35. A method according to claim 32, wherein:

said captured video images includes a first video image and a second video image; and said step of determining an end includes subtracting said first video image from said second video image.

36. A method according to claim 32, further comprising the steps of:

manually pointing a camera at said ball; and sensing camera orientation sensor data about said camera pointing at said ball, said step of determining an end is at least partially based on said camera orientation sensor data.

* * * * *